US008759731B2

(12) United States Patent
McKee et al.

(10) Patent No.: US 8,759,731 B2
(45) Date of Patent: Jun. 24, 2014

(54) PLURALITY OF ACCELERATED COOKING OVENS WITH MASTER-SLAVE POWER ASSEMBLY

(75) Inventors: Philip R. McKee, Frisco, TX (US); Scott S. Smith, Richardson, TX (US); Lee T. Vanlanen, McKinney, TX (US); Earl R. Winkelmann, Garland, TX (US)

(73) Assignee: Appliance Scientific, Inc., Dallas, TX (US)

( * ) Notice: Subject to any disclaimer, the term of this patent is extended or adjusted under 35 U.S.C. 154(b) by 2 days.

(21) Appl. No.: 13/102,920

(22) Filed: May 6, 2011

(65) Prior Publication Data

US 2012/0111857 A1 May 10, 2012

Related U.S. Application Data

(60) Provisional application No. 61/332,152, filed on May 6, 2010, provisional application No. 61/346,321, filed on May 19, 2010.

(51) Int. Cl.
*H05B 6/66* (2006.01)
*H05B 6/68* (2006.01)

(52) U.S. Cl.
USPC ..... 219/756; 219/679

(58) Field of Classification Search
CPC ..... H05B 6/6472; H05B 6/80; H05B 6/683
USPC ..... 219/756, 661, 718, 715, 716, 721, 723, 219/413, 485, 486, 482; 307/38, 39, 41, 307/126, 140, 144.4; 361/88, 91, 93, 99, 361/100, 22
See application file for complete search history.

(56) References Cited

U.S. PATENT DOCUMENTS

| | | | | |
|---|---|---|---|---|
| 2,617,966 | A | 11/1952 | Kilgore | 315/39 |
| 2,898,438 | A | 8/1959 | Gibson | |
| 3,397,817 | A | 8/1968 | Smith | 221/150 |
| 3,767,883 | A | 10/1973 | Staats | 219/10.55 |
| 3,884,213 | A | 5/1975 | Smith | 126/21 A |
| 4,121,079 | A | 10/1978 | Harmon | |
| 4,332,992 | A | 6/1982 | Larsen | 219/999.999 |
| 4,335,290 | A | 6/1982 | Teich | 219/999.999 |
| 4,523,391 | A | 6/1985 | Smith et al. | 34/225 |

(Continued)

OTHER PUBLICATIONS

International Search Report and Written Opinion mailed Aug. 12, 2011 in the corresponding PCT/US11/035624.

(Continued)

*Primary Examiner* — Quang Van
(74) *Attorney, Agent, or Firm* — Ohlandt, Greeley, Ruggiero & Perle, L.L.P.

(57) ABSTRACT

A cooking oven system with a master-slave power assembly therebetween to allow for a single power connection to a 30 ampere single phase electrical outlet includes:

a first oven which runs on about 15 amperes; and a second oven which runs on about 15 amperes with an electrical power system which includes a power cord that extends from the second oven to the electrical inlet of the first oven, thereby allowing the first oven to act as a power master to the second oven which acts as a slave by obtaining power from the first oven; wherein the heated gas at or near the food product disposed in the cooking chamber of either the first or second oven exhibits a flow rate of at least about 100 CFM at 100 percent velocity.

24 Claims, 11 Drawing Sheets

(56) References Cited

U.S. PATENT DOCUMENTS

| | | | | |
|---|---|---|---|---|
| 4,876,426 | A | 10/1989 | Smith | 219/999.999 |
| 5,122,633 | A | 6/1992 | Moshammer et al. | 219/687 |
| 5,128,158 | A | 7/1992 | Chartrain et al. | 426/233 |
| 5,166,487 | A | 11/1992 | Hurley et al. | 219/10.55 |
| 5,254,823 | A | 10/1993 | McKee et al. | 219/10.55 |
| 5,272,299 | A | 12/1993 | Ovadia | 219/999.999 |
| 5,290,575 | A | 3/1994 | Torikata | 426/233 |
| 5,401,940 | A | 3/1995 | Smith et al. | 219/679 |
| 5,416,304 | A | 5/1995 | De La Cruz et al. | 219/730 |
| 5,434,390 | A | 7/1995 | McKee et al. | 219/681 |
| 5,483,044 | A | 1/1996 | Thorneywork et al. | 219/681 |
| 5,521,359 | A * | 5/1996 | Bone | 219/679 |
| 5,556,566 | A | 9/1996 | Cappello et al. | 219/683 |
| 5,558,793 | A | 9/1996 | McKee et al. | 219/391 |
| 5,600,310 | A | 2/1997 | Whipple et al. | |
| 5,676,870 | A | 10/1997 | Wassman et al. | 219/400 |
| 5,683,240 | A | 11/1997 | Smith et al. | 432/59 |
| 5,816,234 | A | 10/1998 | Vasan | 126/21 A |
| 5,818,014 | A | 10/1998 | Smith et al. | 432/59 |
| 5,897,807 | A | 4/1999 | Edgar et al. | 219/700 |
| 5,927,265 | A | 7/1999 | McKee et al. | 126/21 A |
| 5,928,541 | A | 7/1999 | Tsukamoto et al. | 219/400 |
| 5,958,274 | A | 9/1999 | Dobie et al. | 219/681 |
| 5,990,466 | A | 11/1999 | Mckee et al. | 219/746 |
| 6,008,483 | A | 12/1999 | McKee et al. | 219/746 |
| 6,054,695 | A | 4/2000 | Lautenschlager | 219/687 |
| 6,060,701 | A | 5/2000 | McKee et al. | 219/681 |
| 6,140,626 | A | 10/2000 | McKee et al. | 219/681 |
| 6,242,725 | B1 | 6/2001 | Murata et al. | |
| 6,262,406 | B1 | 7/2001 | McKee et al. | 219/681 |
| 6,281,484 | B2 | 8/2001 | Thomas | 219/679 |
| 6,307,190 | B1 | 10/2001 | Thomas | 219/679 |
| 6,392,211 | B2 | 5/2002 | Kim et al. | 219/681 |
| 6,403,937 | B1 | 6/2002 | Day et al. | 219/681 |
| 6,486,453 | B1 | 11/2002 | Bales et al. | 219/702 |
| 6,534,754 | B2 | 3/2003 | Schulz et al. | 219/679 |
| 6,568,215 | B2 | 5/2003 | Schofield et al. | 65/33.2 |
| 6,670,586 | B2 | 12/2003 | Ingemanson et al. | |
| 6,716,467 | B2 | 4/2004 | Cole et al. | 426/466 |
| 6,768,087 | B2 | 7/2004 | Kikuchi | 219/680 |
| 6,805,112 | B2 | 10/2004 | Cole et al. | 126/21 A |
| 6,874,495 | B2 | 4/2005 | McFadden | 126/210 |
| 6,927,371 | B1 | 8/2005 | Hargett et al. | 219/679 |
| 7,055,518 | B2 | 6/2006 | McFadden et al. | 126/21 A |
| 7,087,872 | B1 | 8/2006 | Dobie et al. | 219/681 |
| 7,109,447 | B2 | 9/2006 | Goranson | 219/501 |
| 7,360,533 | B2 | 4/2008 | McFadden et al. | 126/21 A |
| 7,435,931 | B1 | 10/2008 | McKee et al. | 219/683 |
| 2003/0038131 | A1 | 2/2003 | Nomura et al. | 219/735 |
| 2005/0205566 | A1 | 9/2005 | Kassayan | 219/725 |
| 2006/0191918 | A1 | 8/2006 | Ashford et al. | 219/746 |
| 2007/0137633 | A1 | 6/2007 | McFadden | 126/21 A |
| 2008/0283519 | A1 | 11/2008 | McKee et al. | 219/680 |
| 2009/0236331 | A1 | 9/2009 | McKee et al. | |

OTHER PUBLICATIONS

Form PCT/ISA 206 "Invitation to Pay Additional Fees and Where Applicable, Protest Fee" mailed Aug. 18, 2011 in the related PCT/US11/035242.

International Search Report mailed Jun. 27, 2008 in PCT/US08/55518.

International Search Report mailed Nov. 23, 2008 in PCT/US08/06246.

International Search Report mailed Jul. 7, 2009 in PCT/US09/43792.

International Search Report mailed Jul. 9, 2009 in PCT/US09/43812.

International Search Report mailed Jul. 29, 2009 in PCT/US09/43782.

International Search Report mailed Oct. 26, 2009 in PCT/US09/43804.

International Search Report mailed Jun. 18, 2010 in PCT/US10/31299.

International Preliminary Report on Patentability dated Aug. 13, 2012 for PCT application No. PCT/US2011/035624.

* cited by examiner

PLURALITY OF ACCELERATED COOKING OVENS WITH MASTER-SLAVE POWER ASSEMBLY

CROSS REFERENCE TO RELATED PATENT APPLICATIONS

This application claims the benefit of U.S. Provisional Application No. 61/332,152, filed May 6, 2010, and U.S. Provisional Application No. 61/346,321, filed May 19, 2010. The contents of U.S. Provisional Application No. 61/332,152, filed May 6, 2010, and U.S. Provisional Application No. 61/346,321, filed May 19, 2010, are hereby incorporated herein by reference in their entirety.

BACKGROUND

1. Field of the Disclosure

The present disclosure relates generally to a plurality of ovens having circulating heated air and microwaves. More particularly, the present disclosure relates to at least two ovens that are electrically connected and run simultaneously on a single phase 208 or 240 volt 30 ampere electric service via a master-slave power assembly while delivering superior cooking results.

2. Description of Related Art

Hot air impingement and microwave radiation are two different heat/energy sources used to heat and cook a food product. Hot air impingement is based on the transfer of heat from hot air having a higher temperature to an object having a lower temperature, changing the internal energy of the air and the object in accordance with the first law of thermodynamics. On the other hand, microwave radiation consists of electromagnetic waves having a typical wavelength of 12.24 cm or 4.82 inches and a frequency of 2,450 megahertz ("MHz"), which are capable of causing dielectric heating of water, fat and sugar molecules in a food product.

Initially, microwave ovens and ovens based on hot air impingement were separately developed and commercialized. However, it was later demonstrated that a combination of hot air impingement and microwave radiation used in an oven can facilitate high-speed, high-quality cooking. This led to the development and commercialization of quick-cooking hybrid ovens based on both hot air impingement and microwave radiation and has established a new standard in the high-speed cooking technology sector.

While the technology of combining hot air impingement and microwave heating to achieve high-speed cooking in an oven has by now been well established, the current technology does not address a host of new challenges created by such combination, including the problem of inefficient energy use and consequent suboptimal cooking efficiency in the existing high-speed ovens. The fundamental principle of ovens involves conversion of an available power (e.g., electric power) into heat energy to be directed to and absorbed by a food product in the oven to raise its internal temperature. Accordingly, the optimal cooking efficiency of an oven requires that the amount of heat energy converted from a given power supply be maximized; the amount of the heat energy directed to a food product in the oven be maximized; and the amount of the heat energy absorbed and retained by the food product be maximized. However, the current technology of the high-speed ovens using both hot air impingement and microwave radiation is not directed to achieving such optimal cooking efficiency.

As a food product resides in a hot air environment of an oven, temperature gradients, or several boundary layers, form around the cooler food product. The oven cooks the food product by transferring the heat energy to the food product through these temperature gradients. Forced air convection by, for example, a blower can improve the heat transfer by "wiping away" the temperature gradients around the food product and bringing the higher temperature air closer to the food product. Hot air impingement can further improve the heat transfer by "piercing" the temperature gradients with jets of hot air and bringing the air at higher temperature closer to the surface of the food product. However, significant portions of the electric power and the heat energy from the hot air impingement are lost in the process to the oven walls, various openings, plenums and air blower walls that form the hot air circulation and delivery system of the oven.

Typical construction of a combination microwave and hot air impingement oven capable of cooking a 12 inch sub sandwich or 9 inch pizza might have about 15 air inlet holes at the top of the cook cavity, each of about 0.3 inch to 0.5 inch diameter, resulting in a total open surface area of about 2 square inches through which the air leading into the oven cavity passes. It is the passage of the heated air through these relatively small holes at high velocity that results in the hot air jets characteristic of hot air impingement.

Another well-known problem with the technique of hot air impingement is "spotting" in the areas directly impacted by the hot air jets, causing uneven heating or scorching of the surface of the food product. While this problem may be resolved by, for example, reduction in the hot air velocity and/or increase in the diameter of the columns of impinging hot air, such solutions may further reduce the efficiency of the hot air impingement.

In addition, the diameter/cross-sectional area of a column of hot air impingement generally increases as the distance from the hot air jet orifice increases, thereby reducing the efficiency of hot air impingement. While this problem may be solved by increasing the hot air velocity, as discussed above, such solution may further aggravate the spotting problem.

A still further undesirable aspect of conventional ovens using hot air impingement is noise generated by the air impingement. Heated air is forced through openings at a high air velocity and strikes the product that is heated at a high velocity. After striking the product that is heated at a high velocity, the air is drawn out of the oven cavity. The airflow of the air impingement oven causes undesirably high noise levels.

Conventional ovens using infrared elements located inside the oven cavity, such infrared elements typically being located below the product being heated, can collect grease and other particles on a surface below the infrared element. Due to a combination of the close proximity of the infrared element to the grease and the high temperature of the infrared element, the grease and other particles below the infrared element can generate flames that may cause injury to a user or burning of the product being cooked.

In summary, the problem with the current high-speed cooking technology based on a combination of hot air impingement and microwave radiation is that the combination has never been done in a way to optimize the cooking efficiency of the oven. With the suboptimal cooking efficiency in the presence of various sources of inefficiencies in the conversion of electrical power to heat, the currently available high-speed ovens (either commercial models or residential models) require a relatively high level of electric power to operate such that more than a single oven cannot run simultaneously on a single phase 208 or 240 volt 30 ampere electric service.

Consumers of food prepared by high-speed ovens have established standards of cook quality, for example, of food texture and temperature, which are necessary for consumers to readily purchase and consume the food products. A service window has also been established in certain sectors of the foodservice industry, for example, fast food, such that food prepared in high-speed ovens must be delivered in a predetermined time period in order to satisfy the customer's service expectations. For example, a 12 inch sub sandwich cooked in over 35 seconds, or a 9 inch pizza cooked in over 70 seconds is outside of an acceptable service window for many fast food locations. In addition, during busy times such as breakfast, lunch and dinner, high-speed ovens must be able to cook food items one after another to the same quality standards and in the same service times without requiring a resting period for the oven's operating temperature to recover. Accordingly, high-speed ovens must repeatedly achieve the desirable cook quality within the acceptable service window for a variety of food products. Currently available high-speed ovens require a single phase 208 or 240 volt 30 ampere electric service to repeatedly achieve the desirable cook quality of many food items, such as a 12 inch sub sandwich or a 9 inch pizza, within the acceptable service time window. Reduction of consumption of electric power in currently available high-speed ovens so that more than a single oven can simultaneously run on a single phase 208 or 240 volt 30 ampere electric service and cook a variety of food items such as a 12 inch sub sandwich or 9 inch pizza would require either an extension of the cook times beyond the established service window or a recovery period between repetitive cooks.

It will be appreciated by those skilled in the art that during peak operating periods of commercial foodservice establishments, such as breakfast, lunch or dinner periods, the throughput capacity of the oven in which menu items are cooked can be a limiting factor to the total sales, and potentially the profitability, of such establishment, Accordingly, it can be advantageous to a commercial foodservice operation to have multiple ovens capable of being operated simultaneously so that throughput capacity can be increased. In establishments that utilize multiple ovens to cook the same food items, such as 12 inch sub sandwiches, it can be important that each of the ovens cooks the same food item to the same cooking standards in the same times. For example, if two customers standing one behind the other in a fast food service line order the same 12 inch sub sandwich and the cooked food that is delivered to each of the two customers differs noticeably in appearance, temperature, texture or service time, the inconsistency created by such differences can lead to a diminished customer experience.

It will further be appreciated by those skilled in the art that the cost of installing kitchen equipment can be significant, and the cost associated with establishing electric supply for ovens can be a major component of the total cost of installing such equipment. In general, the cost of establishing electric service through larger circuits, such as 30 amperes, is greater than the cost of establishing electric service through smaller circuits, such as 20 amperes, due to factors including building codes that require larger circuit breakers and larger wire gauges for larger electric circuits. Moreover, the cost of establishing multiple electric connections is greater than the cost of establishing a single electric connection. As noted above, currently available high-speed ovens require at least a single phase 208 or 240 volt 30 ampere electric service to operate a single unit properly. Currently available high-speed ovens would require multiple electric connections to operate multiple units simultaneously.

Accordingly, it has been determined by the present disclosure that there is a need for at least two ovens connected in series via a novel master-slave power assembly wherein each oven, independent of the other, circulate an airflow of heated air and that both run simultaneously on one single phase 208 or 240 volt 30 ampere electric service and deliver similar results. That is, the master-slave relationship between the two ovens is uniquely designed and configured to provide up to 15 amperes to each oven so that the ovens operate the same. If either oven seeks to draw more than 15 amperes, than the novel fuse system of the present invention will result in the oven seeking more than 15 amperes to shut-down by the respective fuse associated with such oven being destroyed. It has additionally been determined by the present disclosure that there is a need for a single oven that circulates an airflow of heated air to cook a food item such as a 12 inch sub sandwich or 9 inch pizza and runs on less than a single phase 208 or 240 volt 20 ampere electric service. It has also been determined by the present disclosure that there is a need for an oven circulating an airflow of heated air having noise levels that are reduced relative to impingement ovens. It has additionally been determined by the present disclosure that there is a need for an oven having an infrared element that reduces flames generated thereby.

SUMMARY

A cooking oven system with a master-slave power assembly therebetween to allow for a single power connection to a 30 ampere single phase electrical outlet, the system comprising: a first oven which runs on about 15 amperes, the oven comprising: a cooking chamber comprising a top wall, a bottom wall, a first side wall and a second side wall; at least one microwave generator; at least one set of nozzles, tubes or apertures disposed above a food product disposed within the oven; at least one blower having an revolutions per minute ("RPM") of at least about 3000 at 100 percent velocity, wherein the blower circulates at least a portion of gas from the nozzles, tubes or apertures into the cooking chamber substantially toward the food product and back to the nozzles, tubes or apertures; a thermal energy source that heats the gas; and an electrical power system which includes a power cord that extends from the oven to the 30 ampere single phase electrical outlet, and an electrical inlet. The heated gas at or near the food product disposed in the cooking chamber of the first oven exhibits a flow rate of at least about 100 cubic feet per minute ("CFM") at 100 percent velocity; and a second oven which runs on about 15 amperes, the oven comprising: a cooking chamber comprising a top wall, a bottom wall, a first side wall and a second side wall; at least one microwave generator; at least one set of nozzles, tubes or apertures disposed above a food product disposed within the oven; at least one blower having an RPM of at least about 3000 at 100 percent velocity, wherein the blower circulates at least a portion of gas from the nozzles, tubes or apertures into the cooking chamber substantially toward the food product and back to the nozzles, tubes or apertures; a thermal energy source that heats the gas; and an electrical power system which includes a power cord that extends from the oven to the electrical inlet of the first oven, thereby allowing the first oven to act as a power master to a second oven which acts as a slave by obtaining power from the first oven; wherein the heated gas at or near the food product disposed in the cooking chamber of the second oven exhibits a flow rate of at least about 100 CFM at 100 percent velocity.

Preferably, the power cord comprises a first wire and a second wire, wherein the first wire is serially connected to a first 15 ampere fuse of the first oven and a first 15 ampere fuse of the second oven, and the second wire is serially connected to a second 15 ampere fuse of the first oven and a second 15 ampere fuse of the second oven, whereby the supplied electric service to each of the first and second ovens will not exceed about 15 amperes without destroying at least one of their respective fuses.

Accordingly, each of the first and second ovens are supplied with up to about 15 amperes each, thereby allowing substantially similar food products cooked in either the first or second oven to deliver substantially similar results regardless of which oven the food product is cooked in.

Preferably, each of the first and second ovens has associated therewith a first and second controller, respectively, wherein each the first and second controller regulates the current draw of each of the first oven and the second oven, whereby the maximum current draw of each of the first oven and the second oven is approximately about 15 amperes or less. Alternatively, a single master controller which operates both of said first and second ovens ensures that each oven can only draw a maximum current of approximately about 15 amperes or less.

The above-described and other advantages and features of the present disclosure will be appreciated and understood by those skilled in the art from the following detailed description, drawings, and appended claims.

DETAILED DESCRIPTION OF THE PREFERRED EMBODIMENT

Figure 2:
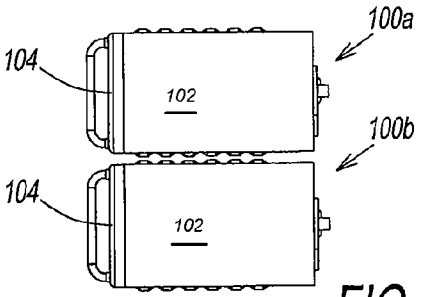
FIG. 2 is a top plan view of the two connected ovens of FIG. 1.

While the present disclosure includes description in terms of a stand-alone or counter-top high-speed oven, it will be apparent to those skilled in the art that an oven according to the present disclosure may alternatively be implemented as a wall unit, a console model having feet adapted to rest on the floor, part of a vending machine, or other variations thereof.

Referring now to the drawings, in particular to FIGS. 1-5*a*, a first oven 100*a* and a second oven 100*b* that are each hybrid ovens are illustrated therein. Each of first oven 100*a* and second oven 100*b* is based on a combination of heated air and microwave according to an exemplary embodiment of the present disclosure. It is first noted that these figures are merely schematic illustrations of an exemplary embodiment of the present disclosure based on various sectional views and are not intended to reflect the exact dimensions, scales or relative proportions of the ovens 100*a*, 100*b* or components thereof, or the full engineering specification thereof, which should be apparent to those skilled in the art.

Each of first oven 100*a* and second oven 100*b* has a housing 102 that is connected to a door 104. The door 104 moves away from housing 102 to uncover an opening to an oven chamber in housing 102. A food product or other item to be heated is placed through the opening into the oven chamber to be heated. Housing 102 may be supported on legs 105. A user interface/controller 150 is positioned on housing 102. A user may communicate inputs to a controller of user interface/controller 150 via an interface also of the user interface/controller, for example, in order to change oven settings.

Figure 5A:
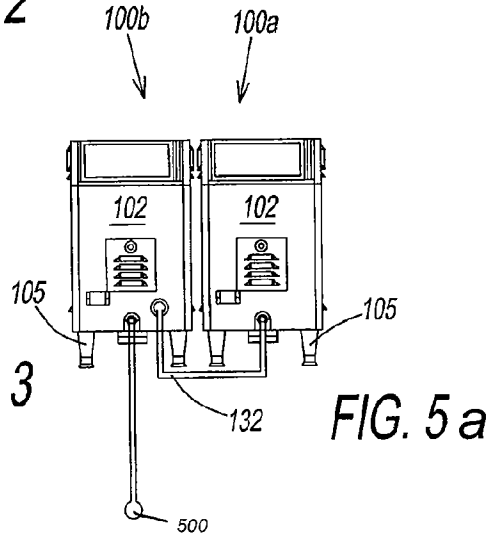
FIG. 5*a* is a rear plan view of the two connected ovens of FIG. 1.
Figure 3:
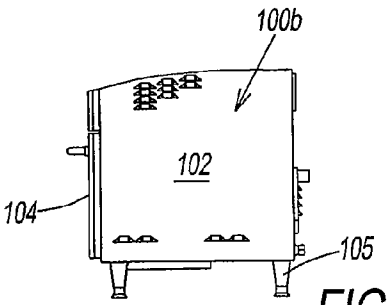
FIG. 3 is a side plan view of the two connected ovens of FIG. 1.
Figure 4:
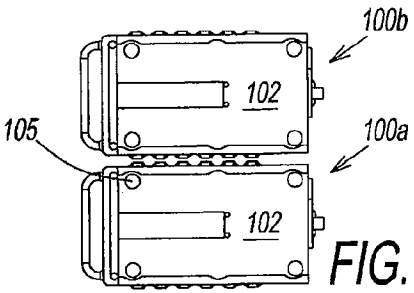
FIG. 4 is a bottom plan view of the two connected ovens of FIG. 1.
Figure 1:
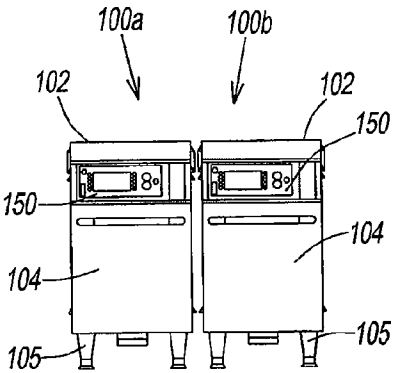
FIG. 1 is a front plan view of an exemplary embodiment of two high-speed ovens connected via a master-slave power assembly according to the present disclosure.

Referring now to FIG. 5*a*, second oven 100*b* has a connector 130. Connector 130 may be a 6 foot cord. Connector 130 removably connects second oven 100*b* to a plug 500 of a single phase 208 or 240 volt 30 ampere electric service. The second oven 100*b* can operate or run on the single phase 208 or 240 volt 30 ampere electric service upon connector 130 connecting to plug 500.

First oven 100*a* is connectable to second oven 100*b* by a connector 132. Connector 132 may be a 6 foot cord, but could be considerably shorter depending upon the desired location of oven 100*a* with respect to oven 100*b*. First oven 100*a* can operate or run on the single phase 208 or 240 volt 30 ampere electric service upon connector 130 of second oven 100*b* connecting to plug 500 and connector 132 of first oven 100*a* connecting to second oven 100*b*. The connection of first oven 100*a* to second oven 100*b* establishes a master-slave assembly. The second oven 100*b* connects to plug 500 of the single phase 208 or 240 volt 30 ampere electric service as the master and first oven 100*a* connects to second oven 100*b* as the slave in order to connect to the single phase 208 or 240 volt 30 ampere electric service through second oven 100*b*.

Second oven 100*b* can operate alone when first oven 100*a* is not connected to second oven 100*b* and second oven 100*b* is connected to plug 500 of the single phase 208 or 240 volt 30 ampere electric service. Upon connecting first oven 100*a* to second oven 100*b*, either or both of first oven 100*a* and second oven 100*b* may operate. Advantageously, first oven 100*a* and second oven 100*b* of the present disclosure can operate simultaneously on a single plug 500 of the single phase 208 or 240 volt 30 ampere-electric service. Both the first and second ovens require about 15 amperes or less to operate at full capacity, such that the total draw when they are plugged in series into an electrical outlet does not exceed 30 amperes, give or take 5 percent. Each of the first and second ovens individually can cook a 12 inch sub sandwich or 9 inch pizza and require about 15 amperes or less to operate at full capacity to repeatedly provide a food product within the service window established within the high-speed oven industry for many food items.

Figure 5B:
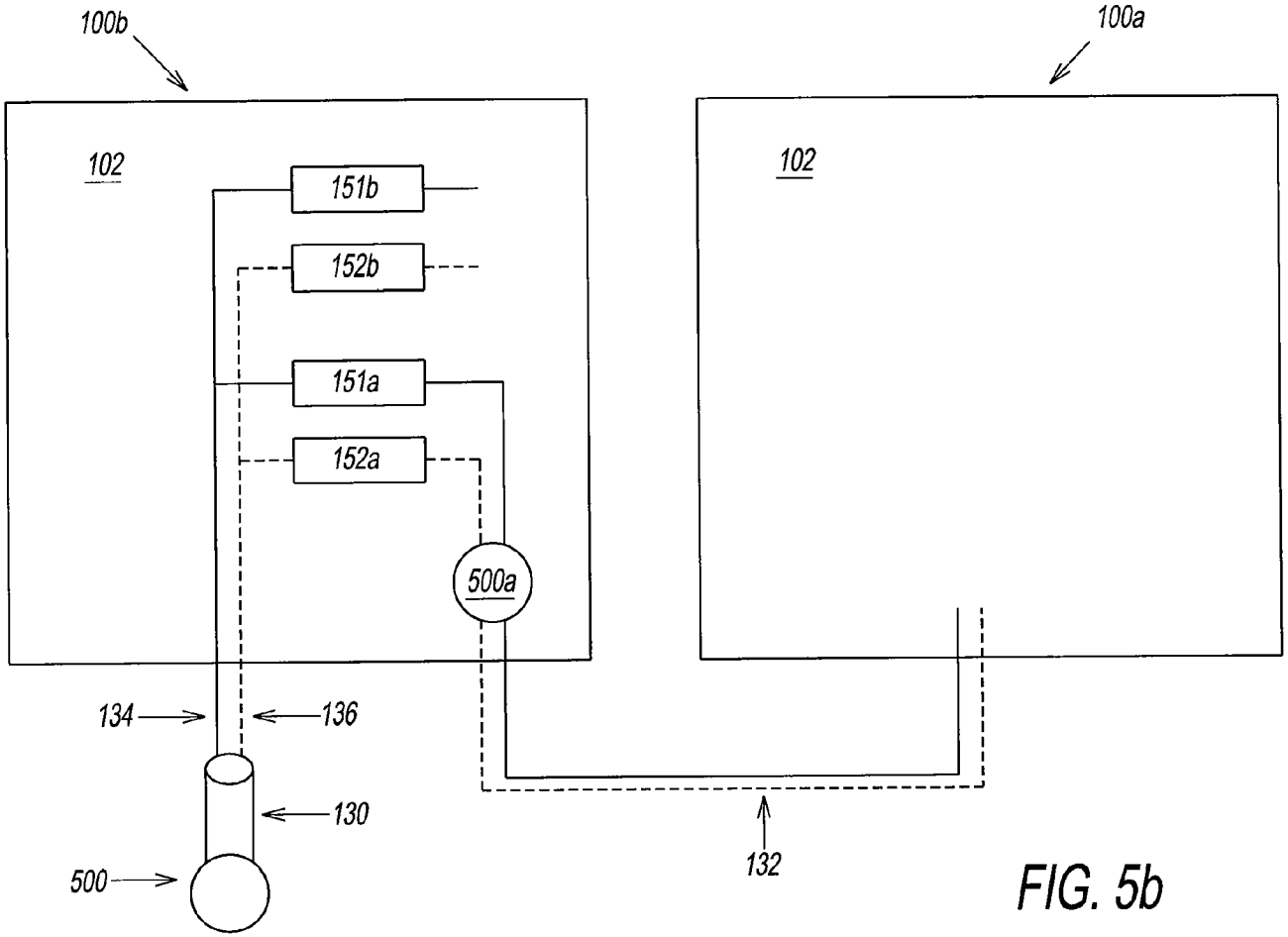
FIG. 5*b* is a schematic diagram of the electrical connection between the two connected ovens of FIG. 5*a*.

Referring now to FIG. 5*b*, second oven 100*b* is connected to plug 500 of the single phase 208 or 240 volt 30 ampere electric service via connector 130. Connector 130 includes wire 134 and wire 136, each of which is of a gauge suitable to be utilized by an appliance connecting to a single phase 208 or 240 volt 30 ampere electric service. Within housing 102 of second oven 100*b*, wire 134 is serially connected to fuses 151*a* and 151*b*, each of which is preferably sized at about 15 amperes. Also within housing 102 of second oven 100*b*, wire 136 is serially connected to fuses 152*a* and 152*b*, each of which is also preferably sized at about 15 amperes. Electrical connection from wires 134 and 136 continues through fuses 151*b* and 152*b* respectively such that second oven 100*b* is suitably supplied with electric service not to exceed about 15 amperes without destroying fuses 151*b* and 152*b*. Electrical connection from wires 134 and 136 also continues through fuses 151*a* and 152*a* to outlet 500*a*, located on the exterior of second oven 100*b*, such that electric current in excess of about 15 Amperes can not flow through outlet 500*a* without destroying fuses 151*a* and 152*a*. Outlet 500*a* is configured to accept generally about a 15 ampere plug (not shown) as specified by the National Electrical Code. Oven 100*a* is electrically connected to fuses 151*a* and 152*a* through connector 132. Through this electrical configuration, one single phase 208 or 240 volt 30 ampere electric service can supply each of second oven 100*b* and first oven 100*a* with about 15 amperes of 208 or 240 volt single phase electric service whereby if either of second oven 100*b* or first oven 100*a* were to draw more than generally about 15 amperes of such electric current, one or more of fuses 151*b*, 152*b*, 151*a*, 152*a* would be destroyed and the oven being supplied through such destroyed fuse would be unable to operate. Through this electrical configuration, each of first oven 100*a* and second oven 100*b* are supplied with 15 amperes of 208 or 240 volt single phase electric supply such if first oven 100*a* and second 100*b* are of the same construction and operating characteristics, then similar food products cooked in either oven will deliver similar results.

Figure 6:
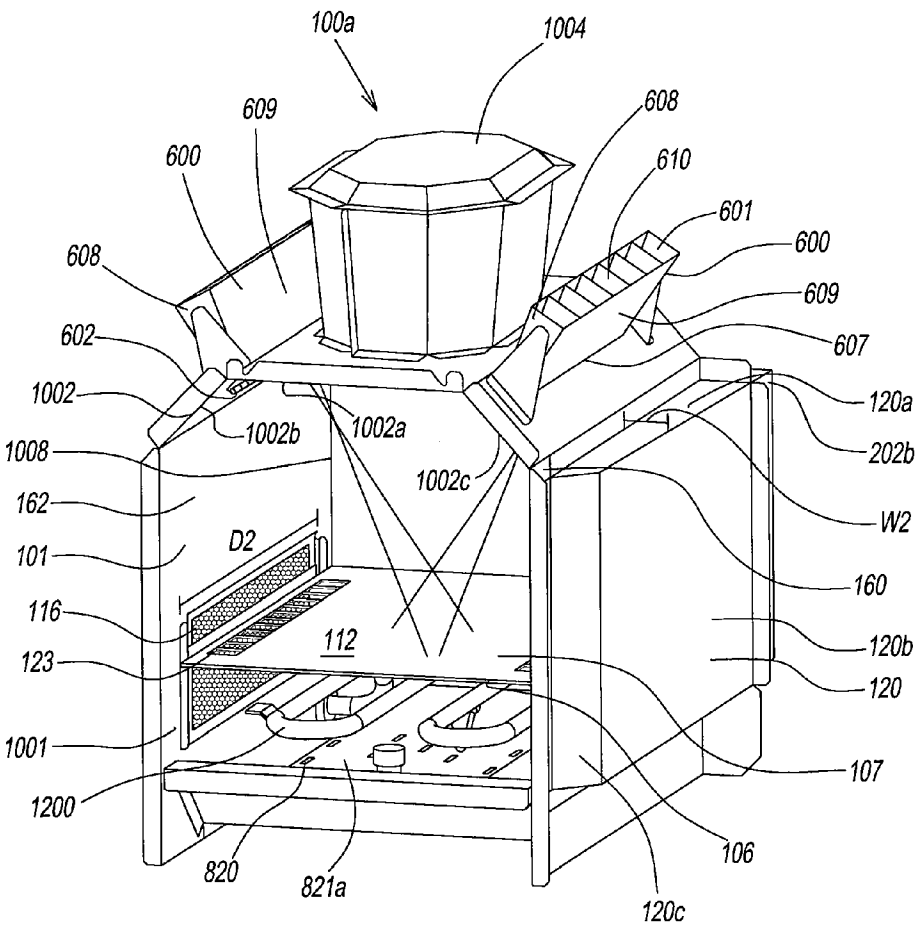
FIG. 6 is a partial front perspective view of one of the two connected ovens of FIG. 1 showing tubes, a launching horn, an oven chamber and a return air plenum.

Referring now to FIGS. 6-9*b*, first oven 100*a* is the same as second oven 100*b* unless noted herein. Accordingly, only first oven 100*a* is described. First oven 100*a* comprises a cooking chamber generally designated 101, which is adapted to receive a food product or other item to be heated to be placed on a support 112 for heating. The support 112 may be constructed in the form of a grill, but in a preferred embodiment is a substantially solid surface constructed of metal that does not pass microwaves. Support 112 comprises a top surface 107 to support the food product and a bottom surface 106. The support 112 may further comprise one or more holes or openings 123 therein to facilitate gaseous communication between above the top surface 107 and below the bottom surface 106 of the support 112. The support 112 may be of any feasible shape, common shapes including rectangular and circular shapes. Referring to FIG. 6, when the "right side" and the "left side" of the support 112 are referred to in the following description, they are intended to refer to the two opposite sides of the support 112 as viewed in FIG. 6, wherein the "right" and the "left" are defined by a right side wall 160 and a left side wall 162 of the cooking chamber 101. It should be appreciated that the "left" and the "right" sides of the support as referred to in the description depend on the configuration of the support and the cooking chamber.

Figure 7:
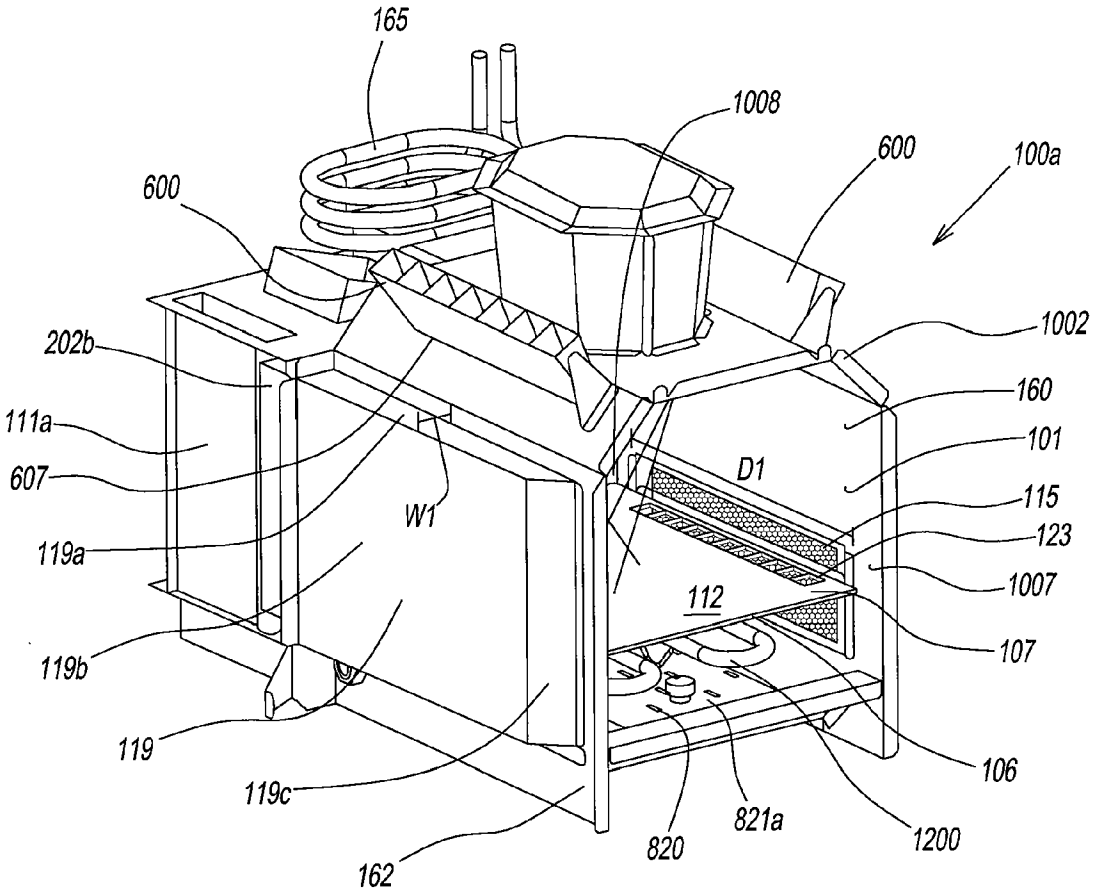
FIG. 7 is a partial front perspective view of the oven of FIG. 6 showing the tubes, the launching horn, the oven chamber, a return air plenum, a duct, and a thermal energy source.
Figure 9A:
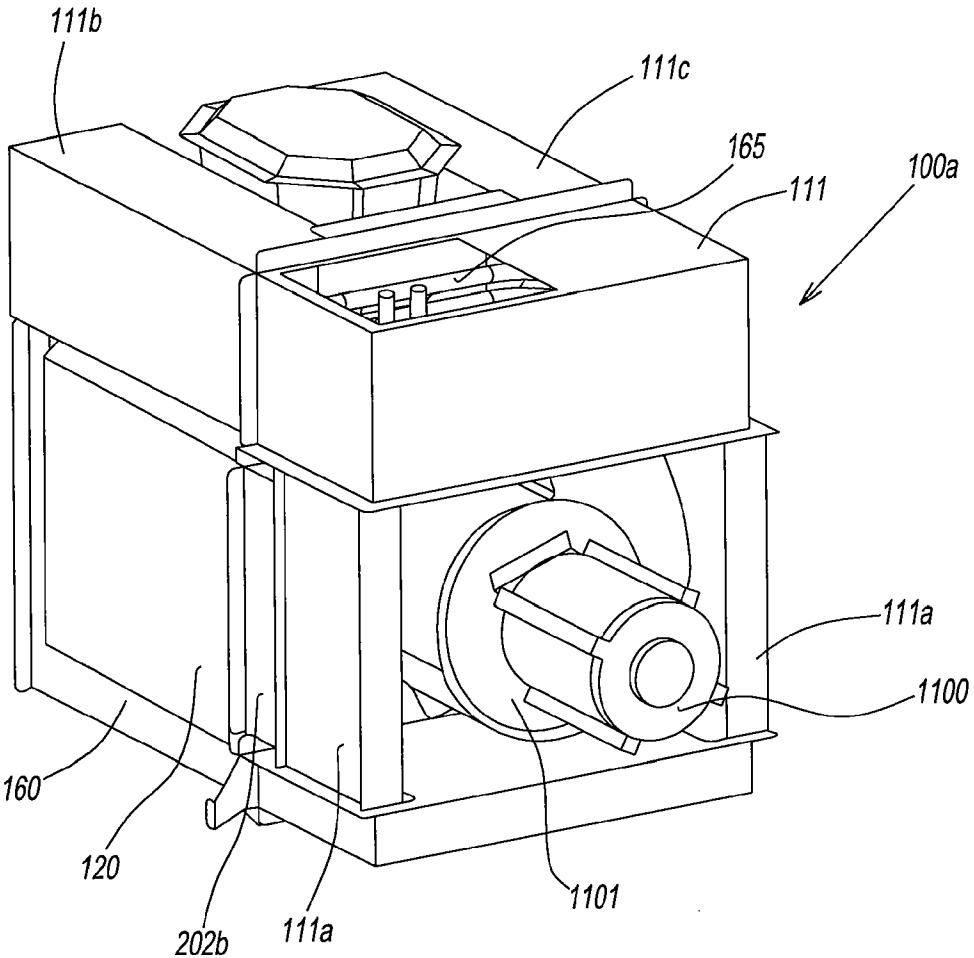
FIG. 9*a* is a partial rear perspective view of the oven of FIG. 6 showing the launching horn, the return air plenum, ducts, the thermal energy source, the fan, the fan motor, and the air inlet housing.
Figure 9B:
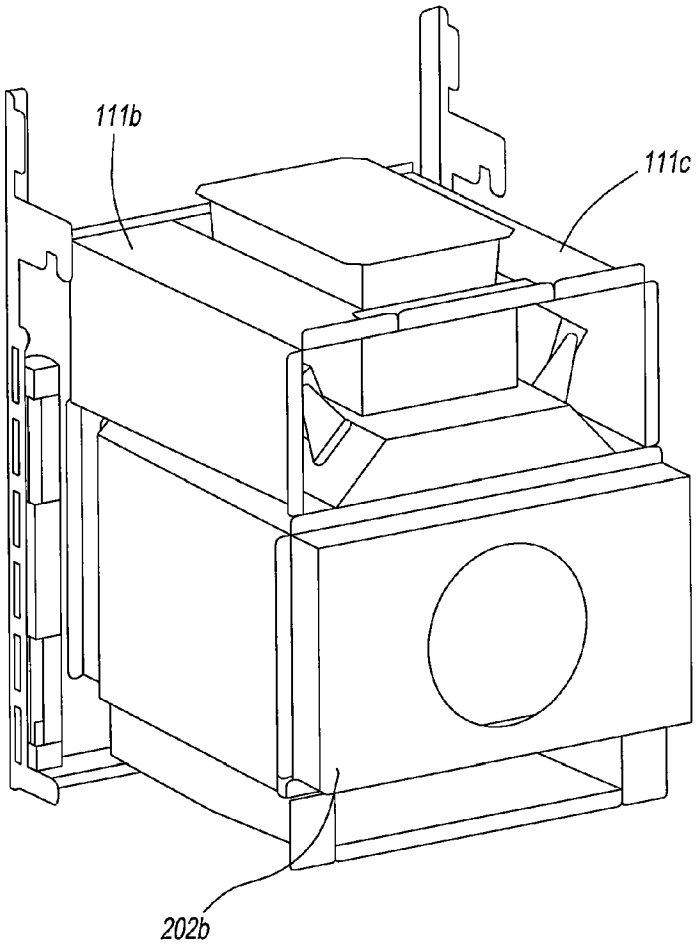
FIG. 9*b* is a view of FIG. 9*a*, wherein the rear blower assembly has been removed to more clearly show chamber 202*b*.

As shown in FIG. 6 and FIG. 7, the cooking chamber 101 is in fluid communication with return air plenums 119, 120 via return air openings 116, 115, respectively, air conduit 202*b* (as shown in FIG. 9*b*), blower 1101, as shown in FIG. 9*a*, an air inlet housing 111, rear and side plenums 111*a*, and left and right air inlet boxes 111*b* and 111*c*, as shown in FIG. 9*a*, which enclose tubes 600, that all form an air circulation and delivery system of first oven 100*a*. The terms "air" and "airflow" are used interchangeably with "gas" and "gas flow" in this description unless otherwise noted. The return air plenums 119, 120 are positioned adjacent to side walls 160, 162 of the cooking chamber 101 and are adapted for gaseous communication with the cooking chamber 101 through return air openings 115, 116. Air opening 115 is formed through side wall 160. Air opening 116 is formed through side wall 162. FIG. 6 and FIG. 7 show that, preferably, at least a portion of return air openings 115, 116 are positioned below support 112 and at least a portion of return air openings 115, 116 are positioned above support 112. Alternatively, return air openings 115, 116 may be positioned entirely below support 112. The return air plenums 119, 120 are adapted to receive the airflow from within the cooking chamber 101 to be guided to the air conduit 202*b*. In a preferred embodiment, holes or openings 123 in support 112 are sized large enough not to unduly restrict the passage of air moving towards return air openings 115, 116, but small enough to minimize the passage of microwaves into the lower portion of cooking chamber 101 which is below bottom surface 106 of support 112. For example, each of openings 123 has no dimension, e.g., length, width, or diameter, that is greater than about 2 inches, and preferably, no dimension greater than about 1.2 inches.

The return air plenums 119, 120 are connected to an air conduit 202*b*, which may be vertically disposed on the back side of first oven 100*a*. The return air plenums 119, 120 each have an interior volume that increases in size toward conduit 202*b*. As shown in FIG. 7, return air plenum 119 may have a top wall 119*a*, a side wall 119*b*, and a front wall 119*c* that connect to form return air plenum 119. Top wall 119*a* increases in a width W1 from front wall 119*c* to conduit 202*b* increasing the size of return air plenum 119. As shown in FIG. 6, return air plenum 120 may have a top wall 120*a*, a side wall 120*b*, and a front wall 120*c* that connect to form return air plenum 120. Top wall 120*a* increases in a width W2 from front wall 120*c* to conduit 202*b* increasing the size of return air plenum 120. The return air plenums 119, 120 that increase in size toward conduit 202*b* reduce a back pressure generated, for example, in return air plenums that do not increase in size toward conduit 202*b*. Back pressure is a pressure that is directed against the heated airflow passing through return air openings 115, 116 from oven chamber 101. Reduced back pressure permits a greater amount of heated gas to be drawn into return air plenums 119, 120.

A catalytic converter (not shown) is positioned in each of return air plenums 119, 120. The catalytic converters filter grease particles and other contaminates from the heated airflow. The contaminates may be combustible substances that react with the materials of the catalytic converters to cause combustion to occur at a lower temperature than would normally be required for such combustion.

The air conduit 202*b* allows gaseous communication between the return air plenums 119, 120 and the air inlet housing 111 positioned on the top of the cooking chamber 101. For the sake of simplicity, the interconnected air circulation and delivery system of the air conduit 202*b*, the return air plenums 119, 120, and the air inlet housing 111 will be referred to as a conduit. Each of the return air plenums 119, 120 may have its own air conduit for gaseous communication with the air inlet housing 111. Air inlet housing 111 serves multiple functions, i.e., (a) receives air from blower 1101 (shown in FIG. 8), (b) channels a portion of the blown air downward through rear and side plenums 111*a*, and (c) provides air to the left and right air inlet boxes 111*b* and 111*c* (shown in FIG. 9*a*).

A thermal energy source, such as parallel heating coils, may be coupled to or disposed in the air conduit 202*b* to heat the air disposed therein. As shown in FIGS. 7-9*a*, thermal energy source 165 may be coupled to or disposed in air inlet housing or rear plenum 111 to heat the air disposed therein. Thermal energy source 165 has, for example, a wattage of between about 2000 Watts to about 3300 Watts. Thermal energy source 165 may include a first heating coil and a second heating coil that are operated independently so that the first heating coil may be activated while the second heating coil is deactivated and vice versa, or the first and second heating coils may each be activated together or not at all. Activating the first heating coil and the second heating coil separately reduces a draw of energy by thermal energy source 165 over activation of the first heating coil and the second heating coil together. One or both of return air plenums 119, 120 may have a thermal energy source therein.

Figure 8:
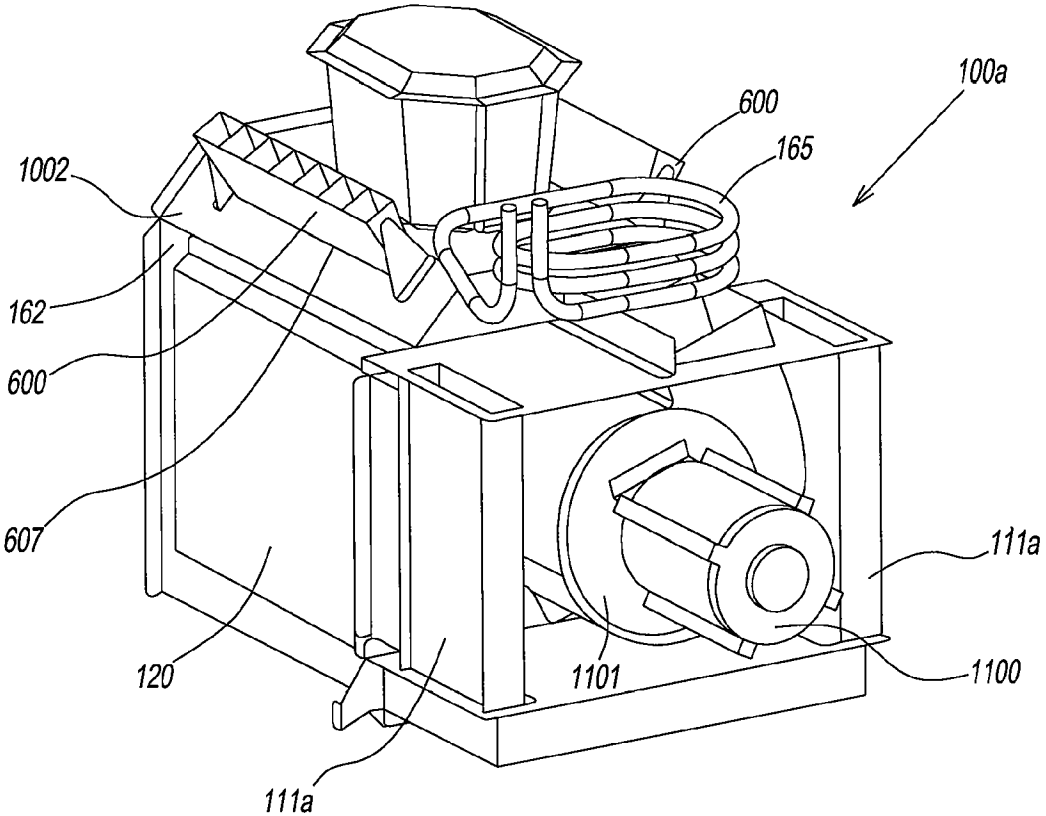
FIG. 8 is a partial rear perspective view of the oven of FIG. 6 showing the tubes, the launching horn, the return air plenum, ducts, the thermal energy source, a conduit, a fan and a fan motor.

As shown in FIG. 8, blower 1101 circulates the air in the air circulation and delivery system defined by the cooking chamber 101, the return air plenums 119, 120, the return air conduit 202*b* and the air inlet housing 111, and provides the desired heated airflow onto the product placed on the support 112 in the cooking chamber 101. Blower 1101 may have a blower motor 1100.

Referring to FIGS. 6-9*b*, oven chamber 101 may include an infrared element 1200 therein. Infrared element 1200 heats the product on support 112 from below the support. Infrared element 1200 may brown the product on support 112 to give a crunchiness to product. A preferred embodiment of first oven 100*a* has infrared element 1200 that heats support 112 that then heats the food product placed thereon. Alternatively, wherein support 112 is a grill, infrared element 1200 browns the food product on support 112 from below the support 112. Infrared element 1200 has a wattage, for example, in the range between about 1200 Watts to about 1600 Watts.

Figure 15:
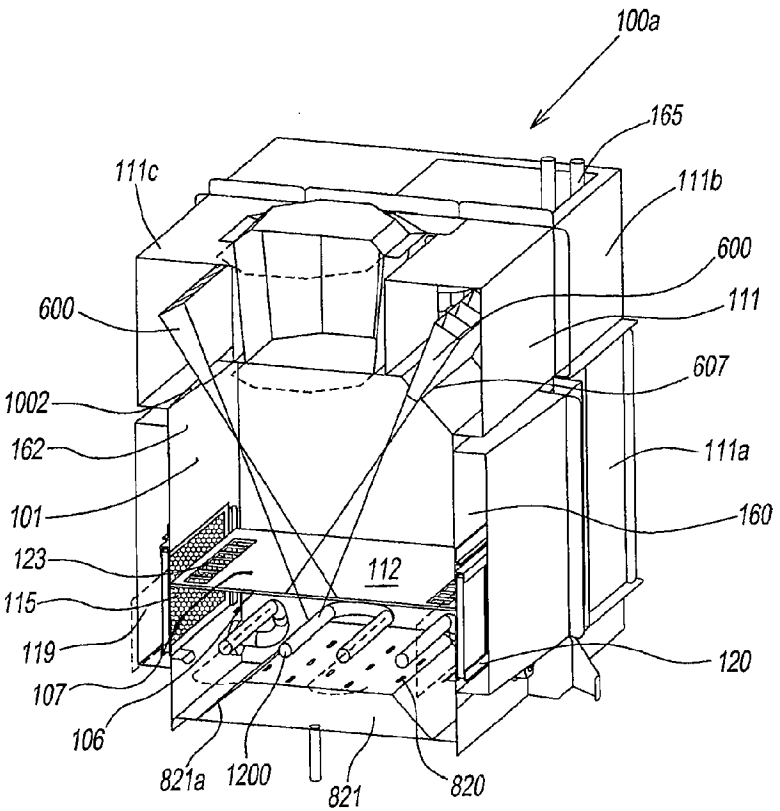
FIG. 15 is a partial front cross sectional perspective view of the oven of FIG. 6 showing the launching horn, the oven chamber, the return air plenums, the duct, the thermal energy source, the tubes, and the air inlet housing.

Referring to FIG. 15, below infrared element 1200 is disposed a bottom plenum 821. Bottom plenum 821 is formed by a wall 821*a* that has bottom air inlets 820. Bottom plenum 821 is in fluid communication with air inlet housing 111 such that heated air traverses rear and side plenums 111*a* into bottom plenum 821 such that the air passes through air inlets 820. In operation, the blower 1101 circulates air into bottom plenum 821 and out bottom air inlets 820 so that the air passes around infrared element 1200. Because of the location of the air inlets 820 beneath infrared element 1200, the airflow passing across infrared element 1200 reduces the internal temperature of infrared element 1200 to less than 1300 degrees Fahrenheit and the temperature of adjacent surfaces to below 600 degrees Fahrenheit, thereby substantially reducing the threat of ignition of the grease disposed on plate 821*a*. The air that passes through bottom air inlets 820 is removed from oven chamber through openings 115, 116 by the negative air pressure generated by the inlet of blower 1101.

Figure 10:
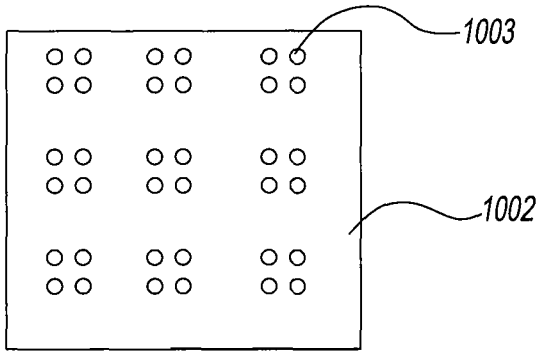
FIG. 10 is a front plan view of a top wall having grouped apertures therethrough.
Figure 11:
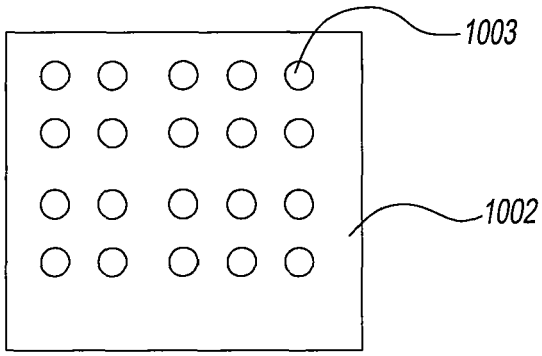
FIG. 11 is a front plan view of the top wall having apertures therethrough in a substantially uniform pattern.
Figure 12:
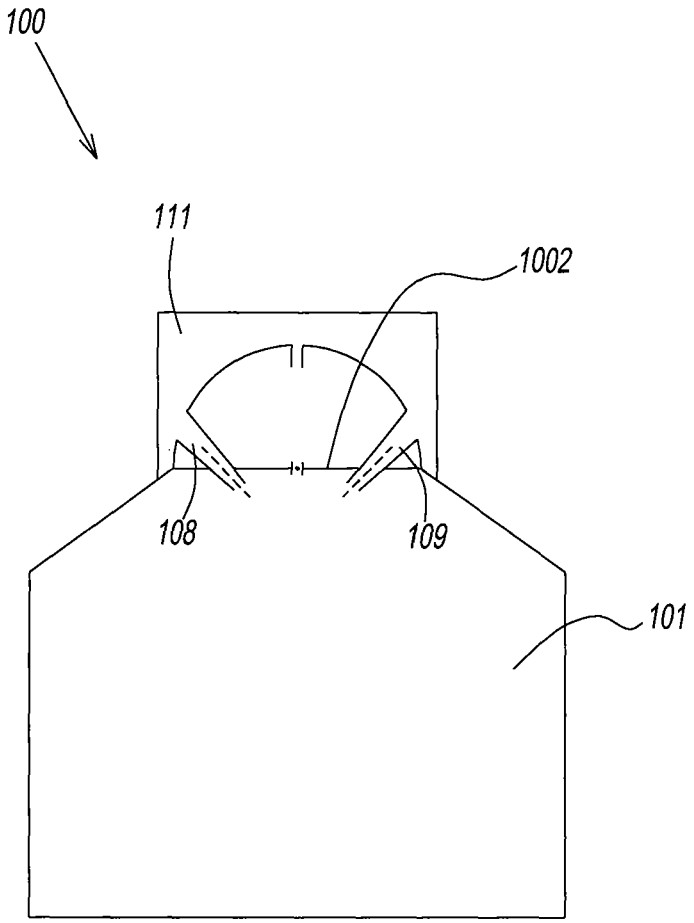
FIG. 12 is a partial side cross sectional view of the air inlet housing, the cooking chamber, and the top wall having nozzles therethrough.

Tubes 600 disposed through a top wall 1002 may be used to provide a heated airflow into cooking chamber 101. As shown in FIG. 6, top wall 1002 may have a substantially horizontal portion 1002*a* and two sloped portions 1002*b*, 1002*c*. Alternatively, top wall 1002 may have apertures 1003 therethrough, as shown in FIG. 10, that are grouped together; top wall 1002 may have apertures 1003 therethrough uniformly distributed, as shown in FIG. 11; top wall 1002 may have nozzles 108 and 109 therethrough, as shown in FIG. 12 and disclosed in U.S. Patent Application Publication No. 2009/0236331 that is hereby incorporated by reference in its entirety; or any combination thereof, any of which may be used to provide a heated airflow into cooking chamber 101. Components 608 and 609 form a tube body and one or more slats or spacers 610. These components may be made of sheet metal. Each tube 600 has a tube inlet 601 in air inlet boxes 111*b* and 111*c* of air inlet housing 111 of first oven 100*a* to receive a heated gas, and a tube outlet 602 in cooking chamber 101 of first oven 100*a* to provide the heated gas into the cooking chamber in the form of an airflow.

The tube 600 may be in the shape of an inverted truncated triangular prism, with the tube inlet 601 corresponding to the base of the prism and the tube outlet 602 corresponding to the truncated top of the prism. The tube inlet 601 is larger than the tube outlet 602 at a ratio optimized to form a tight plume of the heated airflow. The dimension of the tube 600 may optimize the formation of an airflow by forming, for example, a plume array of heated gas and thereby the performance of first oven 100*a*. The length of the tube is preferably long enough to establish a directional flow of heated gas in the form of a plume, but not too long so as to require the height of first oven 100*a* to be objectionable in terms of cost and size considerations. Each tube is preferably wide enough to introduce a sufficient volume of heated gas into the cooking chamber to rapidly cook a food product in the oven. At the same time, the tube outlet 602 is preferably narrow to facilitate the formation of a tight plume of the airflow. The tube 600 forms a planar band of moving heated gas or a plume array, in contrast to air impingement that includes discrete columns of air that are spaced from one another and that strike the food at substantially a 90 degree angle with the support.

The spacers 610 may be placed within the inside of the tube 600, uniformly spaced in parallel. The spacers 610 serve to prevent microwave energies in a cooking chamber from entering the tube 600. For this purpose, the spacers 610 may be less than 1.8 inches, and preferably less than 1.2 inches spaced apart from each other. Each of the spacers 610 may extend from the tube outlet 602 to the tube inlet 601. In an alternative embodiment, each spacer 610 may extend, for example, only about half an inch inward from the tube outlet 602. While both examples serve to substantially prevent microwave entry into the tube 600, it appears that the longer version of the spacer 610, extending from the tube outlet 602 to the tube inlet 601 better enables the evenness of the heated airflow along the width of the tube compared to the shorter version.

A configuration of two of tubes 600 may be included in first oven 100*a*. In a preferred embodiment of first oven 100*a* capable of cooking a 12 inch sub sandwich or 9 inch pizza, each of two tubes 600 may be about 9 inches long with tube outlet 602 that, for example, is about 0.35 inches wide, resulting in a total in a total surface area of about 6 square inches. The tubes 600 have airflows that meet each other above the product being heated. In combination the two tubes 600 provide more even heat transfer to the product being heated, thereby ensuring that more air comes in contact with the food product than conventional impingement airflow. The configuration of two tubes 600 allows for thermal energy source 165 that can heat all of the air drawn through each of the two tubes 600. A surrounding area 607 where the tubes 600 penetrates a top wall 1002 of the cooking chamber 101 is firmly sealed to prevent any air leakage into the cooking chamber.

The heated airflow provided by tubes 600 flow into oven chamber 101 through tubes 600 by an airflow generated by the blower 1101 and out of the oven chamber through openings 115, 116 into return air plenums 119, 120. The openings 115, 116 may be positioned substantially at or along the intersection of the direction of the airflow of heated gas and each of side walls 160, 162 of the cooking chamber 101. In this configuration, the airflow generated by the tube 600 strikes a product on support 112 at an angle and is drawn across the surface of the product toward its edges and the edge of the support and then finally toward openings 115, 116 in such a way that substantially all of the air entering cook chamber 101 from above comes into direct contact with the food such as a 9 inch pizza. The heated airflow is communicated through openings 115, 116 into return air plenums 119, 120. The heated airflow is communicated into conduit 202*b* from return air plenums 119, 120. The heated airflow is communicated into air inlet housing 111 from return conduit 202*b* to be recirculated into oven chamber 101. A portion of the heated airflow may be vented from first oven 100*a* into the ambient environment from oven chamber 101, return air plenums 119, 120, conduit 202*b*, and/or air inlet housing 111. It is found that this configuration reduces a noise level by as much as 80% over conventional impingement ovens that strike the food with air at substantially a 90 degree angle with the support.

One example of a noise reduction of an embodiment of first oven 100*a* as compared to a conventional impingement oven included obtaining data using a decibel (dB) meter two feet away from both the embodiment of first oven 100*a* and the conventional impingement oven—first with a wand of the dB meter located 3 feet above ground and second with the wand of the dB meter located 5 feet above the ground. Both the embodiment of first oven 100*a* and the conventional impingement oven were on carts that put a bottom of both ovens about 30 inches off the ground—which is to say that the measurement taken 3 feet above the ground was about 2 inches high on both ovens after taking into account the 4 inch legs, and the measurement taken 5 feet above the ground was located about 2 inches below a top of both ovens. Again, all measurements were taken at a distance of about 2 feet from both ovens. Table A shows data obtained from the decibel meter:

TABLE A

All Data Taken 2 Feet from Oven

| | 3 feet above ground | | 5 feet above ground | |
|---|---|---|---|---|
| | Idle | 100% blower | Idle | 100% blower |
| conventional impingement oven | 66.0 | 70.5 | 66.4 | 71.0 |
| One embodiment of first oven 100a | 55.2 | 57.7 | 54.9 | 57.6 |

Decibels (dB) are measured in a logarithmic scale, which in general means that an increase from, for example, about 50 dB to about 60 dB means an increase of noise level of 10 times. For example, normal conversation is measured at about 60 dB and a rock concert is measured at about 105 dB. Accordingly, as shown in Table A, the one embodiment of first oven 100*a* has a noise level that is substantially reduced over the conventional impingement oven.

Figure 13:
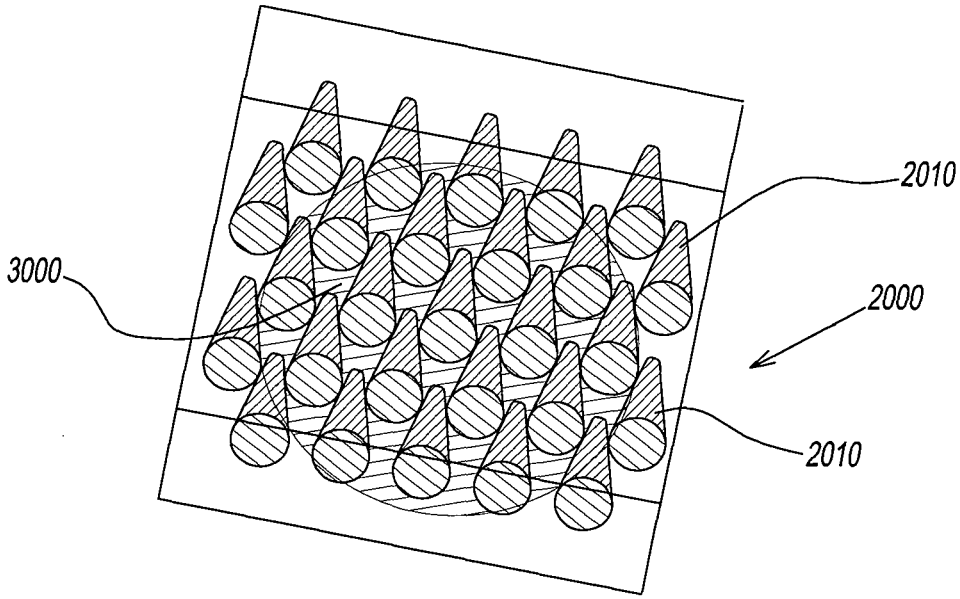
FIG. 13 is a schematic top perspective view of columns of air formed in an impingement oven of the prior art.
Figure 14:
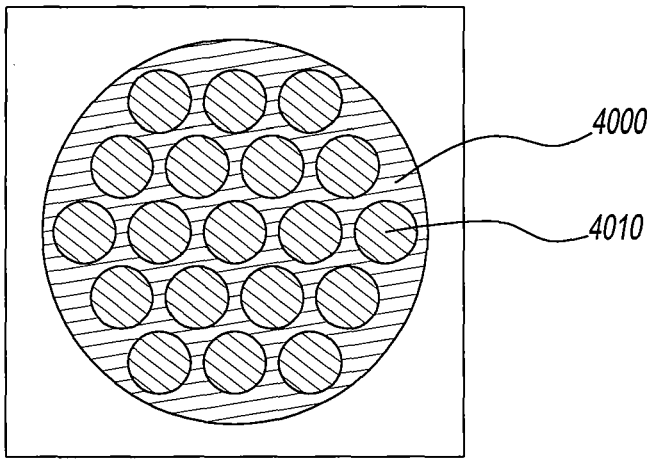
FIG. 14 is a food product cooked in an impingement oven of the prior art.

It is found that this configuration of the tubes 600 that promotes striking a product with heated airflow on support 112 at an angle whereby the heated air is then drawn across the surface of the product toward its edges and the edge of the support and then finally toward openings 115, 116, further improves the heat transfer between the heated air and the product so that a greater amount of heated air contacts the product on support 112 to be heated. It has been unexpectedly found that tubes 600 in combination with return air plenums 119, 120 having increased size toward conduit 202*b* and decreased back pressure further increases the heated air that contacts the product on support 112. It has also been found by the present disclosure that the greater amount of heated air contacting the product on support 112 of first oven 100*a* is achieved at a lower blower speed than conventional impingement ovens, for example, about 3000 RPM to about 4000 RPM at 100 percent velocity. In contrast, as shown in FIG. 13, a conventional impingement oven 2000 has discrete columns of air 2010 that are spaced from one another and that strike food 3000 at substantially a 90 degree angle with the support so that only a portion, for example, about 27%, of food 3000 is contacted by columns of air 2010. Referring to FIG. 14, a food product 4000 cooked in an impingement oven of the prior art is shown. Food product 4000 has darker portions 4010 where the discrete columns of air contacted the food product. The darker portions 4010 show that a lesser portion of the air contacts a food product cooked in an impingement oven of the prior art than the portion of the air that strikes the food product in first oven 100*a*. In addition, in order to force the columns of air to reach the food, conventional impingement ovens require a blower having a blower speed of 6000 RPM to 8000 RPM at 100 percent velocity. Accordingly, first oven 100*a* can achieve faster heating times with a lower use of energy, e.g., electricity, over conventional impingement ovens.

As shown in FIG. 7, return air opening 115 is formed through side wall 160 and extends a distance D1 that is substantially an entire distance from a front 1007 of oven chamber 101 to a rear 1008 of oven chamber 101. As shown in FIG. 6, air opening 116 is formed through side wall 162 and extends a distance D2 that is substantially an entire distance from front 1007 of oven chamber 101 to rear 1008 of oven chamber 101.

Turning now to the microwave-cooking feature of the present disclosure, in addition to the circulation of the heated airflow, first oven 100*a* further comprises a magnetron (not shown), which is positioned at the top of the cooking chamber 101 to launch microwave energy by a waveguide (not shown) through a launching horn 1004 having an antenna (not shown) therein, into the cooking chamber 101 through a ceramic partition separating launching horn 1004 from cooking chamber 101. While first oven 100*a* according to the exemplary embodiment in FIG. 6 uses a single magnetron, the present disclosure is not necessarily limited by the number of magnetrons to generate microwave energies to be guided and launched into the cooking chamber 101. Launching horn 1004 is shown in FIGS. 6-9*a* as having an octagonal shape, however, the launching horn may be any shape, for example, rectangular, as shown in FIG. 9*b*. Furthermore, depending on the configuration of the support 112 and the cooking chamber 101 of the oven, the positions of launching horn 1004 may be selected from various possible choices. For example, in an alternative embodiment, a launching horn may be positioned at the opposite bottom of the cooking chamber.

Referring now to FIGS. 6-9*b*, first oven 100*a* may further comprise a microwave modulator (not shown in the figures) for controlling the amount of the microwave energies propagated into the cooking chamber 101. The microwave modulation may be achieved by various devices. One example of microwave modulation can be achieved by simply switching on and off the power to the magnetron, either manually or by some suitable automatic controller. In another example, the microwave modulation may be achieved by a voltage regulator capable of varying the voltage applied to the magnetron in a controlled manner.

First oven 100*a* has a first controller and second oven 100*b* has a second controller, for example, interface/controller 150. The first controller operates first oven 100*a* independently of the second controller that operates second oven 100*b*. The first controller and second controller each control their respective oven's magnetron, heating elements, blower, etc., such as thermal energy source 165, infrared element 1200, and/or any other electrical components of first oven 100*a* or second oven 100*b* that requires electric power to perform its respective function, so that each of first oven 100*a* and second oven 100*b* draws approximately 15 amperes or less. Alternatively, second oven 100*b* may have a master controller that controls operation of both first oven 100*a* and second oven 100*b*. The master controller may also control each of first oven 100*a* and second oven 100*b* to ensure that each of first oven 100*a* and second oven 100*b* on draws approximately 15 amperes or less.

The present disclosure is based on a single phase wiring system as opposed to a 3 phase wiring system. One skilled in the art may modify these the present disclosure for a 3 phase wiring system based on the present disclosure. The present disclosure is based on the electrical supply standards as may be available within the United States of America. One skilled in the art may modify the present disclosure for the electrical supply that may be available in other countries.

The optimal microwave efficiency may also be achieved by matching the size of the cooking chamber 101 with the microwave load. It is found that the optimal matching can be achieved by sizing preferably all, but at least one, of the vertical height, and horizontal width and depth of the cooking chamber 101 (as viewed in FIG. 6) in integer multiples of the microwave half wavelength (approximately 2.41 inches in free space). Such dimensions of the cooking chamber 101 facilitate the accommodation of standing microwaves in the cooking chamber 101, thereby minimizing the reflection of microwaves at the walls of the cooking chamber and the resulting loss of the microwave energy to the cavities, plenums, magnetrons, etc. Hence, to optimize the microwave efficiency, preferably all, but at least one, of the vertical height, and the horizontal width and depth of the cooking chamber 101 of first oven 100*a* is sized in integer multiples of the microwave half wavelength. In a preferred embodiment cooking support 112, which is preferably constructed of a material that does not pass microwaves and contains holes or openings 123 which are sized not to pass microwaves, serves to reduce the effective size of cooking chamber 101 such that the microwave losses which typically occur below the food support of currently available high-speed ovens are reduced. For example, each of openings 123 has no dimension, e.g., length, width, or diameter, that is greater than about 2 inches, and preferably, no dimension greater than about 1.2 inches.

As discussed herein, consumers of food prepared by high-speed ovens have come to expect certain standards of cook quality within limited service time windows. For example, these certain standards of cook quality must be achieved within less than 35 seconds for a 12 inch sub sandwich, and less than 70 seconds for a 9 inch pizza. Currently available high-speed ovens require a single phase 208 or 240 volt 30 ampere electric service to achieve the desirable cook quality within the acceptable service window. It has been found by the present disclosure that two ovens, first oven 100*a* and second oven 100*b* (each operating independently on 15 amperes or less), can be combined via a master-slave power assembly so as to operate simultaneously on one single phase 240 or 208 volt 30 ampere service while providing acceptable cook quality for two food products from two separate ovens within the acceptable service time window. First oven 100*a* and second oven 100*b* provide acceptable cook quality within the acceptable service time window without warm-up periods between cooking different food products, thereby allowing repetitious cooking in two ovens. Accordingly, first oven 100*a* and second oven 100*b* can both operate to cook two different food products simultaneously without having to provide an additional power outlet. In contrast, only a single currently available high-speed oven can operate on a single phase 208 or 240 volt 30 ampere electric service to cook a food product. In addition, by allowing removable connection of first oven 100*a* to second oven 100*b*, the user is provided flexibility in power consumption and amount of space, or footprint, that the ovens cover.

Further, as discussed herein, a single currently available high-speed oven that can cook a 12 inch sub sandwich or 9 inch pizza requires greater than a 208 volt or 240 volt 20 ampere electric service to achieve the desirable cook quality within the acceptable service window. It has been found by the present disclosure that each of first oven 100*a* and second oven 100*b* can cook a 12 inch sub sandwich or a 9 inch pizza individually while requiring a 208 volt or 240 volt about 15 ampere electric service to achieve acceptable cook quality within the acceptable service time window established within the high-speed oven industry. Accordingly, first oven 100*a* and second oven 100*b* require a reduced electric service over currently available high-speed ovens.

It should also be noted that the terms "first", "second", "third", "upper", "lower", "above", "below", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cooking oven system with a master-slave power assembly therebetween to allow for a single power connection to a 30 ampere single phase electrical outlet, said system comprising:

a first oven which runs on about 15 amperes, said first oven comprising: a cooking chamber comprising a top wall, a bottom wall, a first side wall and a second side wall; at least one microwave generator; at least one set of nozzles, tubes or apertures disposed above a food product disposed within said first oven; at least one blower having an RPM of at least about 3000 at 100 percent velocity, wherein said blower circulates at least a portion of gas from said nozzles, tubes or apertures into said cooking chamber substantially toward said food product and back to said nozzles, tubes or apertures; a thermal energy source that heats said gas; and an electrical power system which includes a power cord that extends from said oven to said 30 ampere single phase electrical outlet, and an electrical inlet; wherein said heated gas at or near said food product disposed in said cooking chamber of said first oven exhibits a flow rate of at least about 100 CFM at 100 percent velocity; and a second oven which runs on about 15 amperes, said second oven comprising: a cooking chamber comprising a top wall, a bottom wall, a first side wall and a second side wall; at least one microwave generator; at least one set of nozzles, tubes or apertures disposed above a food product disposed within said second oven; at least one blower having an RPM of at least about 3000 at 100 percent velocity, wherein said blower circulates at least a portion of gas from said nozzles, tubes or apertures into said cooking chamber substantially toward said food product and back to said nozzles, tubes or apertures; a thermal energy source that heats said gas; and an electrical power system which includes a power cord that extends from said second oven to said electrical inlet of said first oven, thereby allowing said first oven to act as a power master to said second oven which acts as a slave by obtaining power from said first oven; wherein said heated gas at or near said food product disposed in said cooking chamber of said second oven exhibits a flow rate of at least about 100 CFM at 100 percent velocity, wherein when said power cord that extends from said second oven is connected to said electrical inlet of said first oven, both of said first oven and said second oven operate simultaneously, wherein said power cord comprises a first wire and a second wire, wherein said first wire is serially connected to a first 15 ampere fuse of said first oven and a first 15 ampere fuse of said second oven, and said second wire is serially connected to a second 15 ampere fuse of said first oven and a second 15 ampere fuse of said second oven, whereby the supplied electric service to each of said first and second ovens will not exceed about 15 amperes without destroying at least one of their respective fuses.

2. The system according to claim 1, wherein said food product in each of said first and second ovens is disposed on a product support in each oven, respectively.

3. The system according to claim 2, wherein said product support of each of said first oven and said second oven is constructed to minimize the passage of microwaves below such supports.

4. The system according to claim 3, wherein the gas from said nozzles, tubes or apertures strikes said food product on said product support at an angle and is drawn across a surface of the food product toward its edges and an edge of the product support and then finally toward said first and second return plenum openings in such a way that substantially all of said gas comes into direct contact with the food product.

5. The system according to claim 1, wherein said first and second ovens each comprise first and second return plenum openings disposed in said first wall and said second wall, respectively.

6. The system according to claim 5, wherein said first and second return plenum openings are disposed within said first and second walls from front to back of the respective oven, whereby the back pressure in a conduit disposed between said first and second return plenum openings to said nozzles or tubes is reduced.

7. The system according to claim 6, wherein said first and second return plenum openings are between about 66 percent to 100 percent of the length of their respective side walls from front to back of said oven.

8. The system according to claim 5, wherein said first and second return plenum openings are in fluid communication with said nozzles, tubes or apertures via respective conduits which are tapered such that the conduit end disposed near said return plenum opening has a smaller dimension than the conduit end disposed near their respective nozzles, tubes or apertures.

9. The system according to claim 1, wherein said apertures are spaced apart from one another and have a round or oval cross-sectional shape, wherein said apertures have a cross-sectional diameter of equal to or greater than about 1.2 cm.

10. The system according to claim 1, wherein said apertures are clustered into a plurality of groupings of apertures.

11. The system according to claim 1, further comprising a first tube, nozzle or aperture which dispenses a first airflow of the gas into the cooking chamber, and a second tube, nozzle or aperture which dispenses a second airflow of the gas into the cooking chamber, wherein the first and the second tubes, nozzles or apertures direct the first and the second airflows in a direction from or near the top wall towards substantially opposite portions of the support at a non-zero angle that is less than 90 degrees with respect to the surface of the food product support, wherein the first and second airflows meet above said food product.

12. The system according to claim 1, wherein said at least one microwave generator of each of said first oven and said second oven comprises a single magnetron.

13. The system according to claim 1, further comprising a plurality of sets of nozzles, tubes or apertures.

14. The system according to claim 1, wherein said thermal energy source is disposed adjacent to said sets of nozzles, tubes or apertures.

15. The system according to claim 1, wherein each of said first and second ovens further comprise at least one infrared heat element disposed beneath said food product.

16. The system according to claim 15, further comprising a secondary source of heated air which is positioned to direct secondary heated air from near the bottom of said cooking chamber, such that said secondary heated air passes over or comes into contact with said infrared heating element.

17. The system according to claim 15, wherein said infrared element has a wattage in the range between about 1200 Watts to about 1600 Watts.

18. The system according to claim 1, wherein said first and second ovens each exhibits a noise level when cooking said food product in the range between about 55.2 decibels to about 57.6 decibels.

19. The system according to claim 1, wherein said blower has a RPM less than about 4000 at a 100 percent velocity.

20. The system according to claim 19, wherein said blower has an RPM of about 3,600 at 100 percent velocity.

21. The system according to claim 1, wherein said thermal energy source has a wattage of between about 2000 Watts to about 3300 Watts.

22. The system according to claim 1, wherein each of said first and second ovens are supplied with up to about 15 amperes each, thereby allowing substantially similar food products cooked in either said first or second oven to deliver substantially similar results regardless of which oven said food product is cooked in.

23. The system according to claim 1, wherein each of said first and second ovens has associated therewith a first and second controller, respectively, wherein each said first and second controller regulates the voltage draw of each of said first oven and said second oven, whereby the maximum voltage draw of each of said first oven and said second oven is approximately about 15 amperes or less.

24. The system according to claim 1, further comprising a controller which operates both of said first and second ovens so as to ensure that each oven can only draw a maximum current of approximately about 15 amperes or less.

* * * * *